US011623451B2

(12) United States Patent
Murakami et al.

(10) Patent No.: US 11,623,451 B2
(45) Date of Patent: Apr. 11, 2023

(54) LIQUID STORAGE CONTAINER

(71) Applicant: CANON KABUSHIKI KAISHA, Tokyo (JP)

(72) Inventors: Taketsugu Murakami, Kanagawa (JP); Junichiro Iri, Kanagawa (JP); Hiroyuki Murayama, Kanagawa (JP); Satoru Takahashi, Kanagawa (JP); Yusuke Hashimoto, Kanagawa (JP); Hiroaki Kusano, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 43 days.

(21) Appl. No.: 17/323,900

(22) Filed: May 18, 2021

(65) Prior Publication Data

US 2021/0370682 A1 Dec. 2, 2021

(30) Foreign Application Priority Data

May 28, 2020 (JP) ..... JP2020-093155

(51) Int. Cl.
*B41J 2/175* (2006.01)

(52) U.S. Cl.
CPC ..... *B41J 2/17506* (2013.01); *B41J 2/17513* (2013.01); *B41J 2/17566* (2013.01); *B41J 2/17596* (2013.01); *B41J 2002/17573* (2013.01)

(58) Field of Classification Search
CPC .... B41J 2/175; B41J 2/17506; B41J 2/17509; B41J 2/17513; B41J 2/17553; B41J 2/17566; B41J 2/17596; B41J 2002/17573
See application file for complete search history.

(56) References Cited

U.S. PATENT DOCUMENTS 5,953,030 A * 9/1999 Ishinaga ..... B41J 2/17559 347/86
6,000,788 A * 12/1999 Iida ..... B41J 2/17596 137/859
6,474,796 B1 * 11/2002 Ishinaga ..... B41J 2/175 347/85
8,136,931 B2 * 3/2012 Miyazawa ..... B41J 2/17596 347/85
8,491,109 B2 * 7/2013 Takeda ..... B41J 2/17513 347/85
2015/0197097 A1 * 7/2015 Kobayashi ..... B41J 29/13 347/92
2016/0144628 A1 * 5/2016 Sato ..... B41J 2/175 347/85

FOREIGN PATENT DOCUMENTS

JP 2002-248794 9/2002

* cited by examiner

*Primary Examiner* — Anh T Vo
(74) *Attorney, Agent, or Firm* — Venable LLP

(57) ABSTRACT

Provided is a liquid storage container that allows for a simplified structure and a reduction in the size and the cost of a printing apparatus. To this end, the liquid storage container includes: two liquid chambers partitioned from each other; a flow path through which liquid can move between the liquid chambers; a valve configured to open and close the flow path; a refilling port that is configured to be opened and closed and through which a liquid chamber can be refilled with the liquid; and a pressure adjustment mechanism that is provided in a liquid chamber configured not to be refilled with the liquid through the refilling port and that adjusts a pressure in the printing head.

19 Claims, 10 Drawing Sheets

LIQUID STORAGE CONTAINER

BACKGROUND OF THE INVENTION

Field of the Invention

The present invention relates to a liquid storage container that is mounted in a printing apparatus to store liquid.

Description of the Related Art

Japanese Patent Laid-Open No. 2002-248794 proposes an ink printing apparatus that includes a sub-tank provided between an ink tank for retaining ink and a printing head and manages the hydraulic head in the sub-tank to perform accurate printing.

However, the configuration of Japanese Patent Laid-Open No. 2002-248794 requires many mechanisms such as a pressurizing unit for pumping the ink from the ink tank to the sub-tank, a liquid surface level-detection unit, and a valve for automatically opening and closing an ink flow path, and thus there is a problem that the structure of the ink printing apparatus is complicated, leading to a large size and high cost.

SUMMARY OF THE INVENTION

In view of the above, the present invention provides a liquid storage container that allows for a simplified structure and a reduction in the size and the cost of a printing apparatus.

Thus, a liquid storage container of the present invention is a liquid storage container capable of supplying liquid to a printing head through a supply path, the printing head being configured to eject the liquid, and capable of retaining the liquid, including: at least two liquid chambers partitioned from each other; a flow path through which the liquid can move between the liquid chambers; a valve configured to open and close the flow path; a refilling port that is configured to be opened and closed and through which one of the liquid chambers can be refilled with the liquid; and a pressure adjustment mechanism that is provided in one of the liquid chambers, the one being configured not to be refilled with the liquid through the refilling port, and that adjusts pressures in the supply path and the printing head.

According to the present invention, it is possible to provide a liquid storage container that allows for a simplified structure and a reduction in the size and the cost of a printing apparatus.

Further features of the present invention will become apparent from the following description of exemplary embodiments with reference to the attached drawings.

DESCRIPTION OF THE EMBODIMENTS

First Embodiment

Hereinafter, a first embodiment of the present invention is described with reference to the drawings.

Figure 1A:
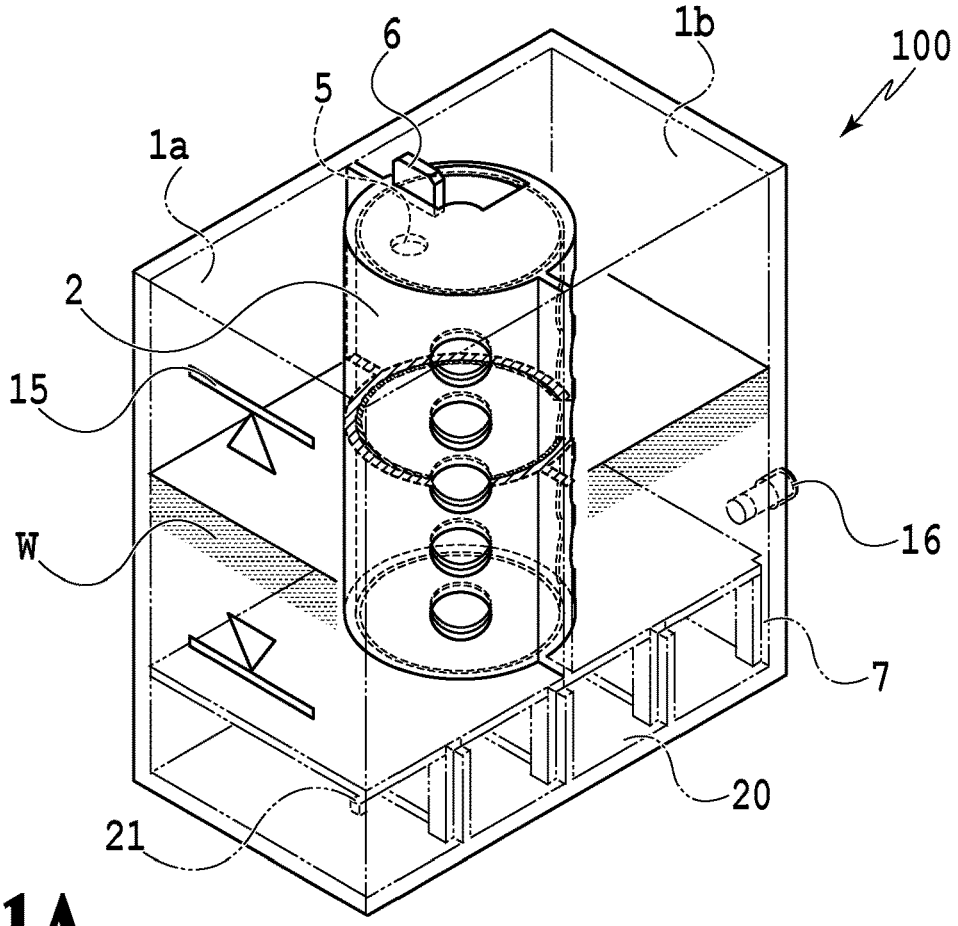
FIG. 1A is a diagram illustrating a liquid storage container.
Figure 1B:
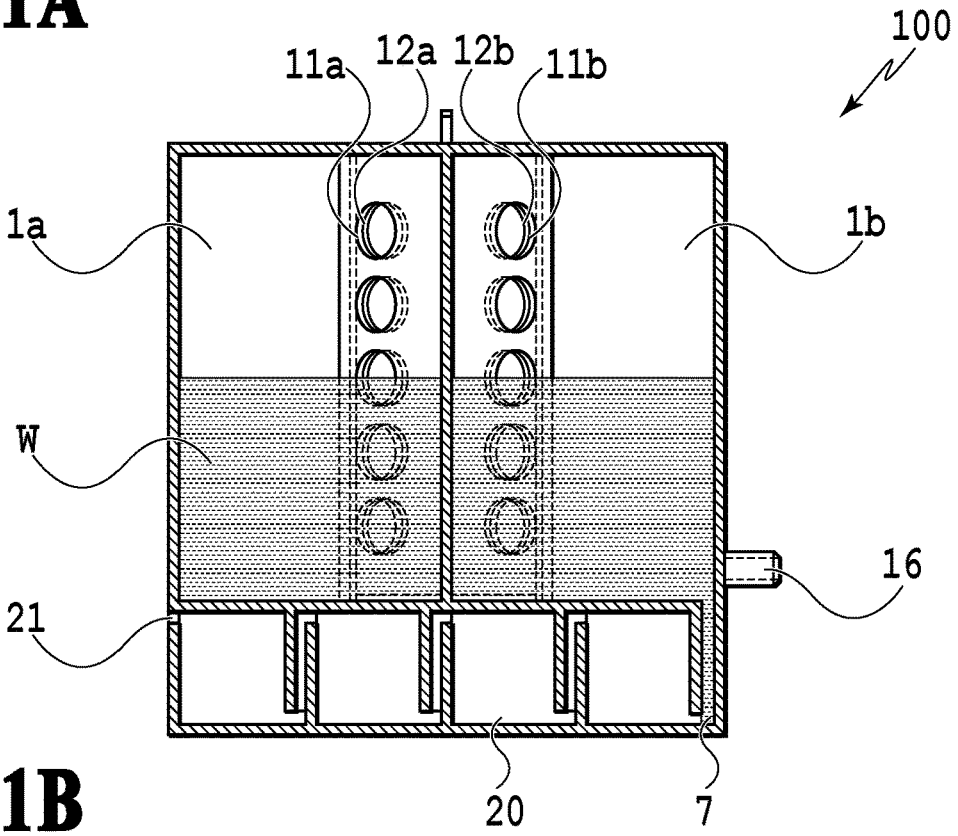
FIG. 1B is a diagram illustrating the liquid storage container.

FIGS. 1A and 1B are drawings illustrating a liquid storage container 100 in this embodiment. FIG. 1A is a transparent perspective view, and FIG. 1B is a cross-sectional view. The liquid storage container 100 can retain liquid and mainly includes two liquid chambers 1*a* and 1*b* and a cylindrical rotative lid 2, and the rotative lid 2 has a structure that is rotatable by a predetermined angle about an axis of the cylinder. Ink W is stored as the liquid stored in the liquid storage container 100. It is desirable that the material of the liquid storage container 100 be a material that has a resistance and wettability to the ink W and has a low gas-permeability to some extent such as, for example, polyethylene. Additionally, it is desirable that the surfaces of the container be entirely or partially transparent or semitransparent so that the amount of the ink inside the container can be visually checked.

The liquid chamber 1*a* and the space in the rotative lid 2 form ink flow paths connected via holes 11*a* of the liquid chamber 1*a* and holes 12*a* of the rotative lid 2; however, depending on the rotation angle of the rotative lid 2, the holes 11*a* and the holes 12*a* do not communicate with one another, and the flow paths are thus interrupted. Likewise, the liquid chamber 1*b* and the space inside the rotative lid 2 form ink flow paths via holes 11*b* and holes 12*b* communicating with one another, and the communication and interruption of the flow paths are switched depending on the rotation angle of the rotative lid 2.

Specifically, the rotative lid 2 serves as a valve for the communication between the liquid chamber 1*a* and the liquid chamber 1*b*. The rotation angle of the rotative lid 2 is restricted by limiting the movable range of a lug 6 provided on the rotative lid 2 using an opening provided in the top surface of the liquid storage container 100. Additionally, a refilling port 5 is provided in the top of the rotative lid 2, and the refilling port 5 is switched between a close state and an open state depending on the rotation angle of the rotative lid 2. The refilling port 5 is configured such that through the refilling port 5, the liquid chamber 1*a* can be refilled with the liquid via the rotative lid 2, and the refilling port 5 in FIG. 1A is closed.

An indicator 15 is provided on a side surface of the liquid chamber 1*a* and indicates an upper limit and a lower limit of the liquid surface level of the ink W. The indicator 15 provides a rough indication of the ink replacement time for the user and the ink refilling amount after the ink W in the liquid storage container 100 has gradually been consumed due to printing and the like. A joint 16 is provided on a side surface of the liquid chamber 1*b*. A tube is connected to the joint 16, and the other end of the tube is connected to a printing head and an ink holding chamber on a carriage of the printing apparatus, thereby forming an ink supply path capable of supplying ink.

In the orientation in use, a gas introduction unit 7, which is a part of a pressure adjustment mechanism, is provided in a lower portion of the liquid chamber 1*b*. The gas introduction unit 7 is always open to the atmosphere, and in the case where the ink W is consumed due to printing and the like, gas enters the liquid chamber 1*b* through the gas introduction unit 7. The gas introduction unit 7 serves as a reference position for the ink static pressure, and the ink static pressure is determined depending on a level difference based on the position of the gas introduction unit 7. Hence, as long as the tube is filled with the ink W, the pressure inside the ink holding chamber connected via the tube is stable regardless of the change in the liquid surface level in the liquid chamber 1*b*. In the gas introduction unit 7, the ink W is held without falling down because of the surface tension; however, there is a further preferred configuration including a labyrinth structure 20 as illustrated in FIGS. 1A and 1B to deal with the leaking of the ink due to vibration and the like during transportation of the printing apparatus, for example. The labyrinth structure 20 includes an atmosphere communication port 21 open to the atmosphere so as to make the gas introduction unit 7 open to the atmosphere.

Regarding the indicator 15, the lower limit position is set higher than the joint 16 so that the ink static pressure in the liquid chamber 1*b* is kept constant regardless of the consumption amount of the ink W. The upper limit position is set as appropriate such that the refilling amount is enough to avoid frequent ink replacement by the user. The shape and the like of the gas introduction unit 7 is set as appropriate such that the ink W is held by the surface tension without dripping.

Figure 2A:
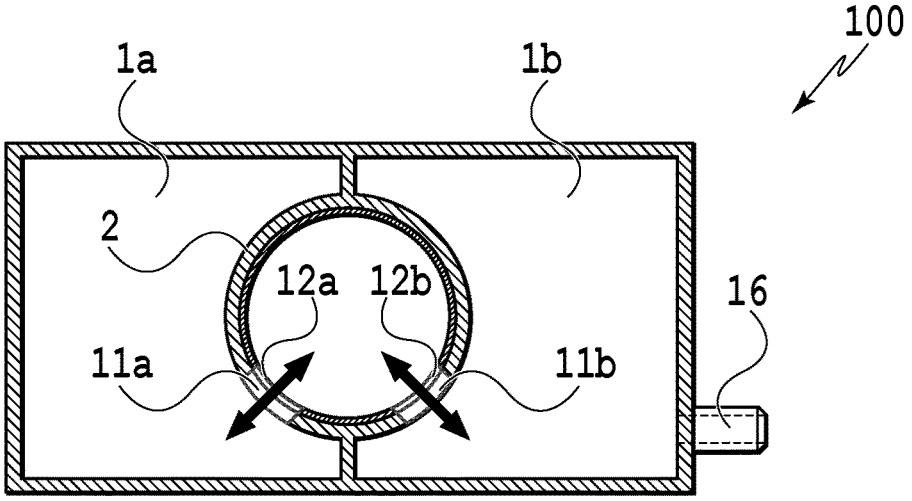
FIG. 2A is a diagram illustrating ink refilling operations in the liquid storage container in sequence.

FIGS. 2A to 6B are diagrams illustrating ink refilling operations in the liquid storage container 100 in sequence. The ink refilling operations are performed by changing the rotation angle of the rotative lid 2 step-by-step. As illustrated in FIGS. 2A and 2B, in the case where the user finds that the amount of ink in the liquid storage container 100 has been decreased, and that the liquid surface of the ink has reached the lower limit of the indicator 15, the user performs the ink refilling operations. Ink refilling may be made at any time before the liquid surface level reaches the lower limit, and it does not necessarily have to be the time when the liquid surface level is at the lower limit.

Figure 2B:
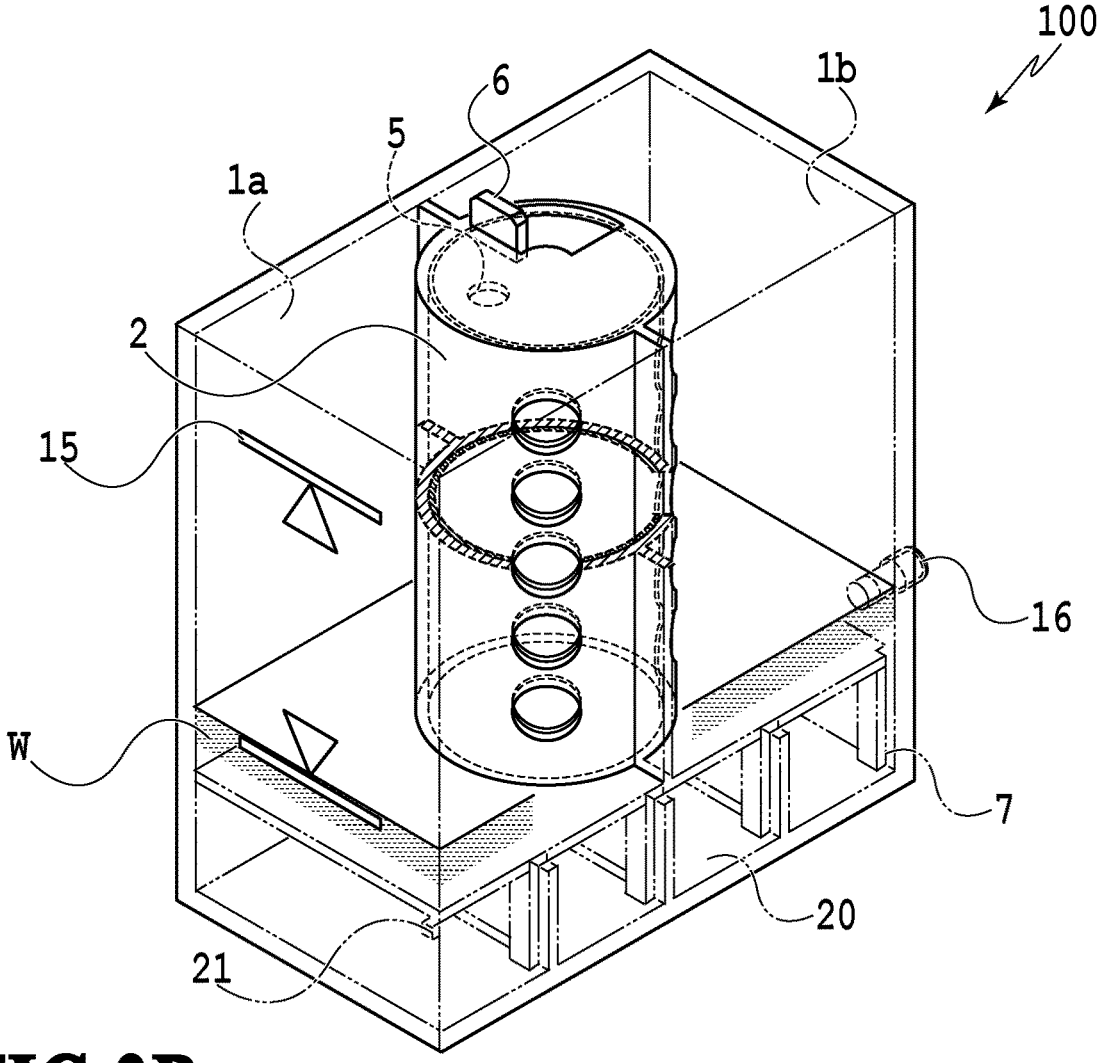
FIG. 2B is a diagram illustrating the ink refilling operations in the liquid storage container in sequence.

In the state illustrated in FIGS. 2A and 2B, the liquid chamber 1*a* and the space inside the rotative lid 2 are connected to each other via the holes 11*a* and the holes 12*a* communicating with one another, and the liquid chamber 1*b* and the space inside the rotative lid 2 are connected to each other via the holes 11*b* and the holes 12*b* communicating with one another. Thus, the ink W can move freely between the spaces, and, the liquid storage container 100 can be used as a large volume ink storage container. The refilling port 5 is closed, and the ink pressure is adjusted by the effect of the gas introduction unit 7. In this state, the ink can be supplied to the printing head and the ink holding chamber.

Figure 3A:
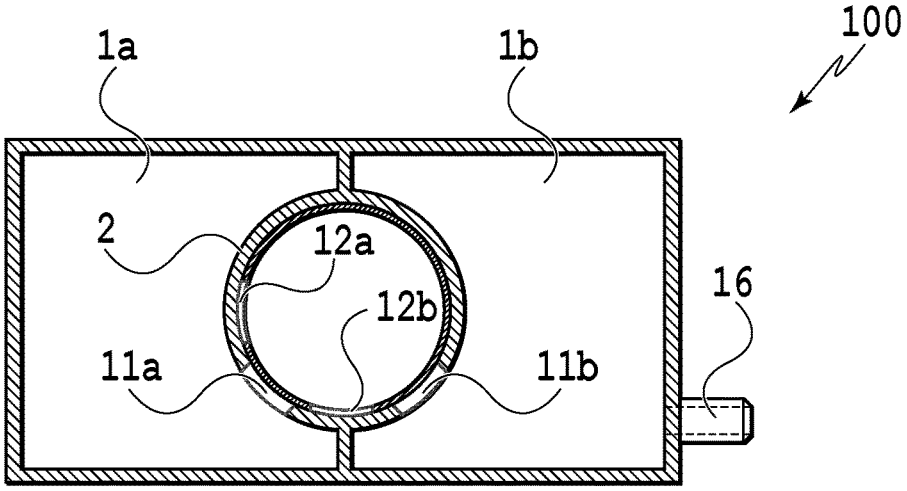
FIG. 3A is a diagram illustrating the ink refilling operations in the liquid storage container in sequence.
Figure 3B:
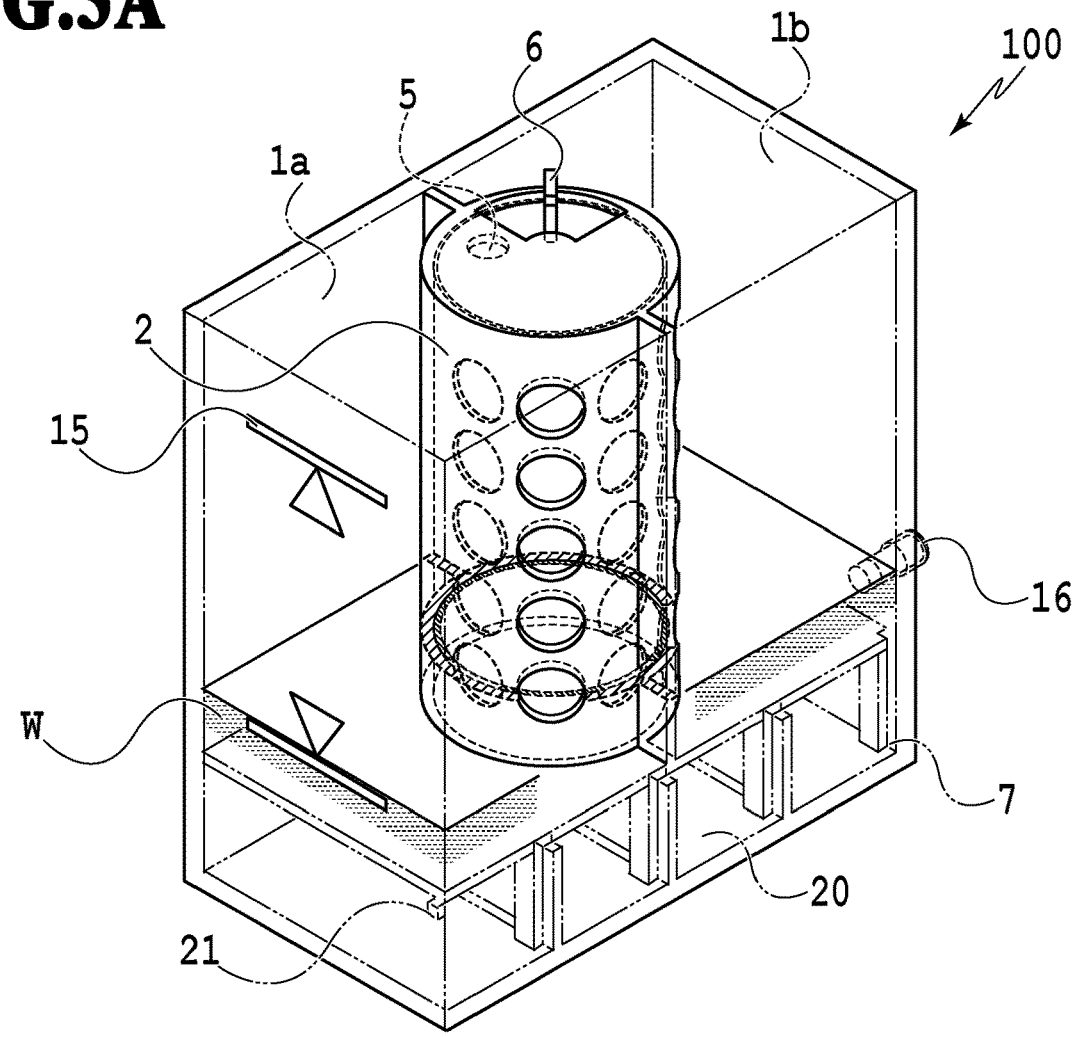
FIG. 3B is a diagram illustrating the ink refilling operations in the liquid storage container in sequence.

Thereafter, in the case where the user starts the ink refilling operations, the user rotates the rotative lid 2 about 45° in the clockwise direction as illustrated in FIGS. 3A and 3B. In the state illustrated in FIGS. 3A and 3B, the holes 11*a* and the holes 12*a* and the holes 11*b* and the holes 12*b* does not communicate with one another, and the liquid chamber 1*a*, the space inside the rotative lid 2, and the liquid chamber 1*b* are separated from one another. The refilling port 5 is closed.

Figure 4A:
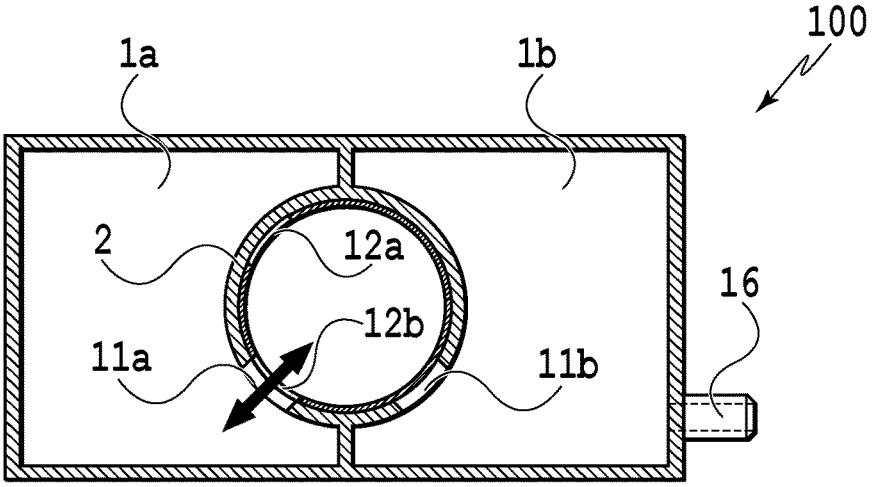
FIG. 4A is a diagram illustrating the ink refilling operations in the liquid storage container in sequence.
Figure 4B:
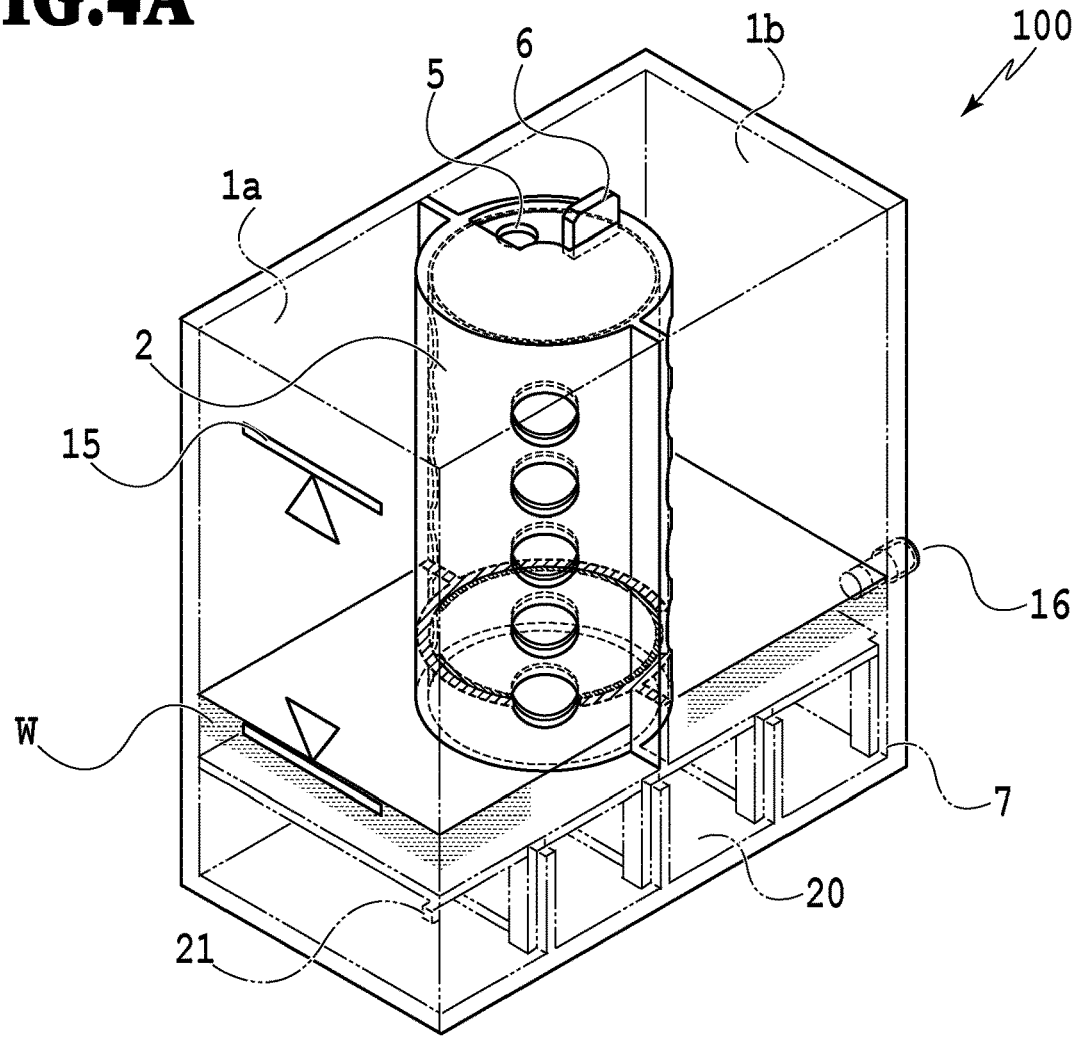
FIG. 4B is a diagram illustrating the ink refilling operations in the liquid storage container in sequence.
Figure 5A:
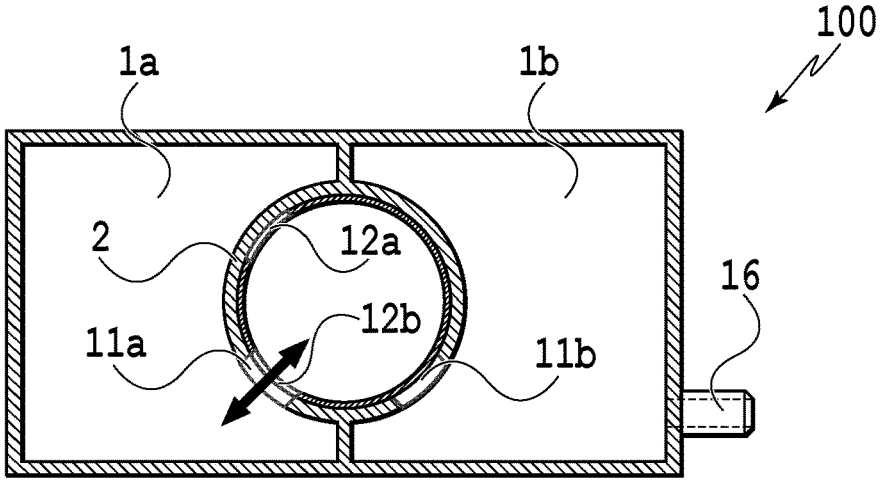
FIG. 5A is a diagram illustrating the ink refilling operations in the liquid storage container in sequence.
Figure 5B:
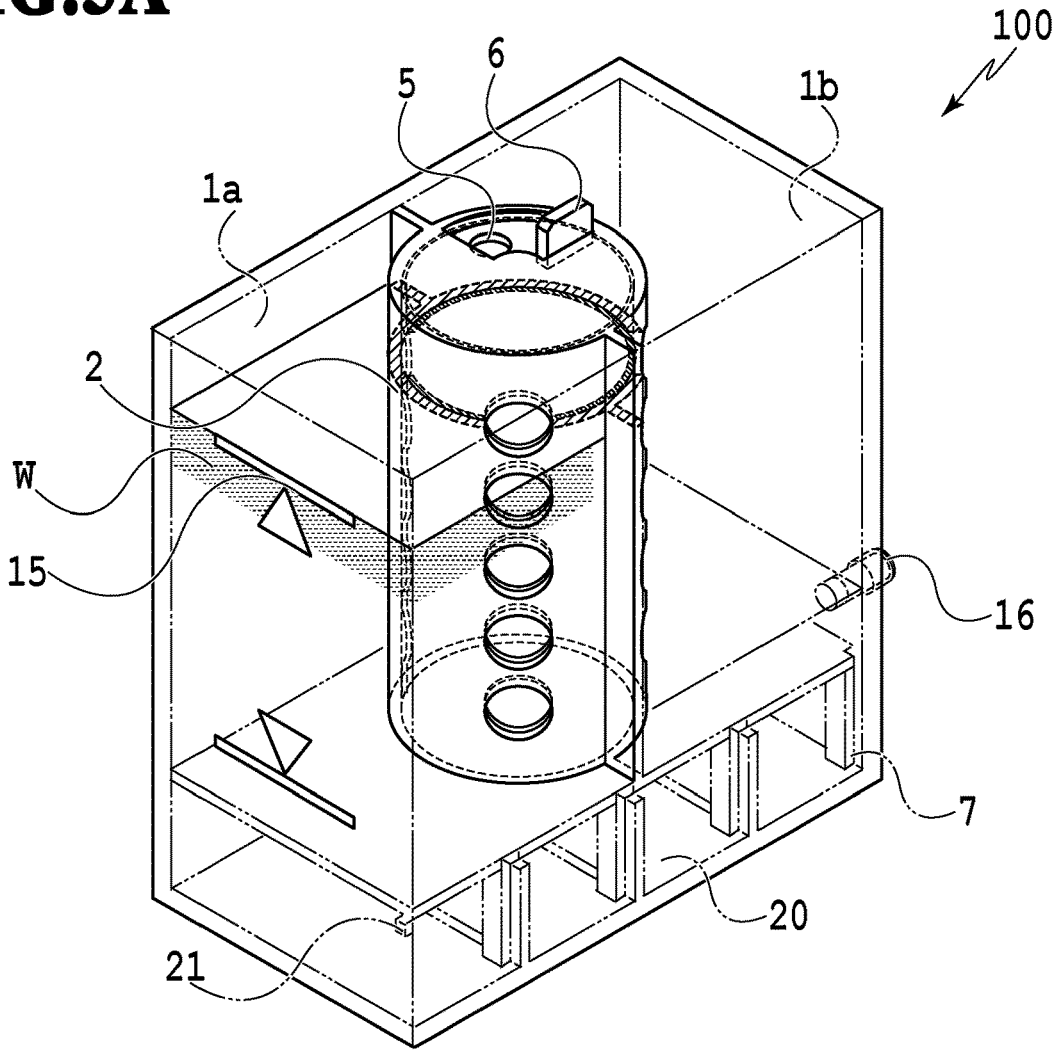
FIG. 5B is a diagram illustrating the ink refilling operations in the liquid storage container in sequence.

Thereafter, in the case where the user further rotates the rotative lid 2 about 45° in the clockwise direction, the liquid storage container 100 is in the state illustrated in FIGS. 4A and 4B. The lug 6 is moved to a movable-range end defined by the opening provided in the top surface of the liquid storage container 100. In this state, the liquid chamber 1*b* is still separated; however, the holes 11*a* of the liquid chamber 1*a* and the holes 12*b* of the rotative lid 2 communicate with one another, and the liquid chamber 1*a* and the space inside the rotative lid 2 are connected to each other again. In the state illustrated in FIGS. 4A and 4B, the refilling port 5 is open, allowing the ink refilling. In this state, the user refills the liquid chamber 1*a* with ink through the refilling port 5 via the rotative lid 2. The user refills the liquid chamber 1*a* with ink to the upper limit of the indicator 15 as illustrated in FIGS. 5A and 5B while checking the indicator 15 on the side surface of the liquid chamber 1*a*. Regarding the amount of ink W for refilling, the liquid chamber 1*a* does not necessarily have to be refilled with the ink to the upper limit of the indicator 15, and any amount of ink W lower than or equal to the upper limit of the indicator 15 may be put in for refilling.

While the liquid chamber 1*a* is being refilled with the ink W, the liquid chamber 1*b* is not refilled with the ink since the space inside the rotative lid 2 and the liquid chamber 1*b* do not communicate with each other. While the liquid chamber 1*a* is being refilled with the ink W, the ink supply path from the liquid chamber 1*b* to the printing head and the ink holding chamber remains open, and the ink pressures in the liquid chamber 1*b*, the supply path, and the printing head are in states adjusted by the effect of the gas introduction unit 7. Consequently, even in a case where the refilling port 5 is open for the liquid chamber 1*a*, the ink never flows backward in the liquid chamber 1*b*, and thus it is possible to perform printing during the ink refilling without degradation in the accuracy of printing.

Figure 6A:
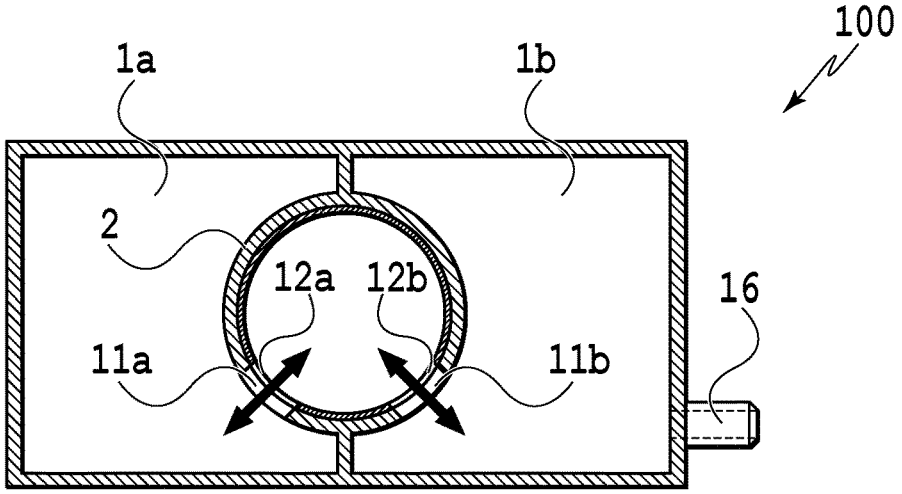
FIG. 6A is a diagram illustrating the ink refilling operations in the liquid storage container in sequence.
Figure 6B:
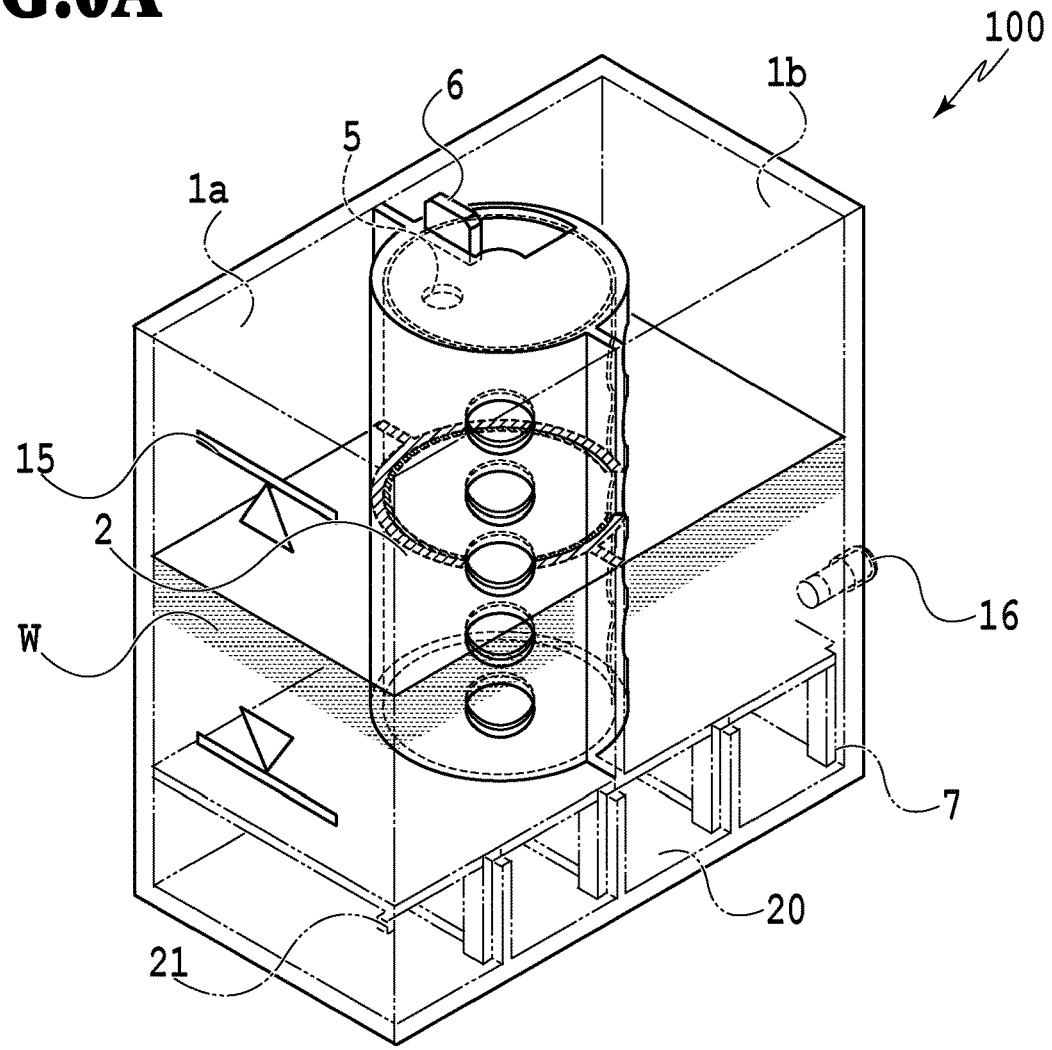
FIG. 6B is a diagram illustrating the ink refilling operations in the liquid storage container in sequence.

Thereafter, the user rotates the rotative lid 2 about 90° in the counterclockwise direction as illustrated in FIGS. 6A and 6B, and the liquid storage container 100 returns to the all-closed state illustrated in FIGS. 2A and 2B. The inside spaces of the liquid chamber 1*a*, the liquid chamber 1*b*, and the rotative lid 2 are connected to one another again, and the ink filled inside the liquid chamber 1*a* and the rotative lid 2 moves also into the liquid chamber 1*b*. Thus, the ink refilling operations are completed.

As described above, the liquid storage container includes: two liquid chambers partitioned from each other; a flow path through which liquid can move between the liquid chambers; a valve configured to open and close the flow path; a refilling port that is configured to be opened and closed and through which a liquid chamber can be refilled with the liquid; and a pressure adjustment mechanism that is provided in a liquid chamber configured not to be refilled with the liquid through the refilling port and that adjusts a pressure in the printing head. Consequently, it is possible to provide a liquid storage container that allows for a simplified structure and a reduction in the size and the cost of a printing apparatus.

Second Embodiment

Hereinafter, a second embodiment of the present invention is described with reference to the drawings. Since the basic configuration of this embodiment is similar to that of the first embodiment, a characteristic configuration is described below.

Figure 7A:
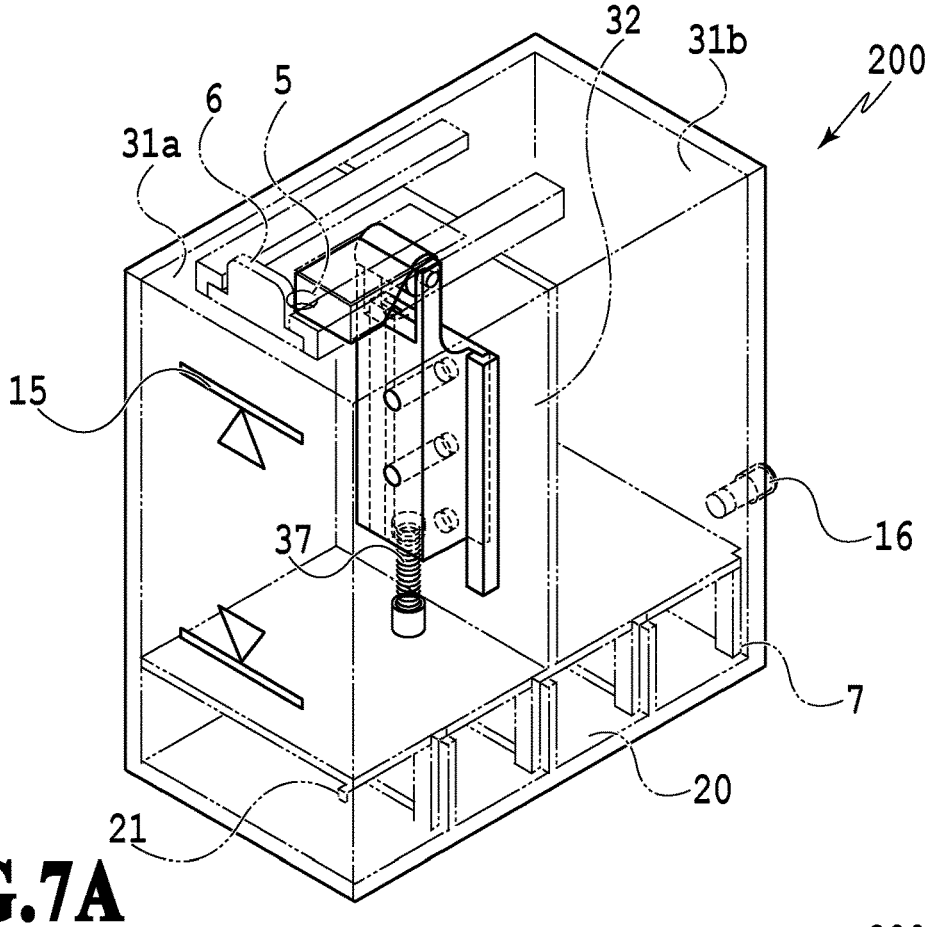
FIG. 7A is a diagram illustrating a liquid storage container.
Figure 7B:
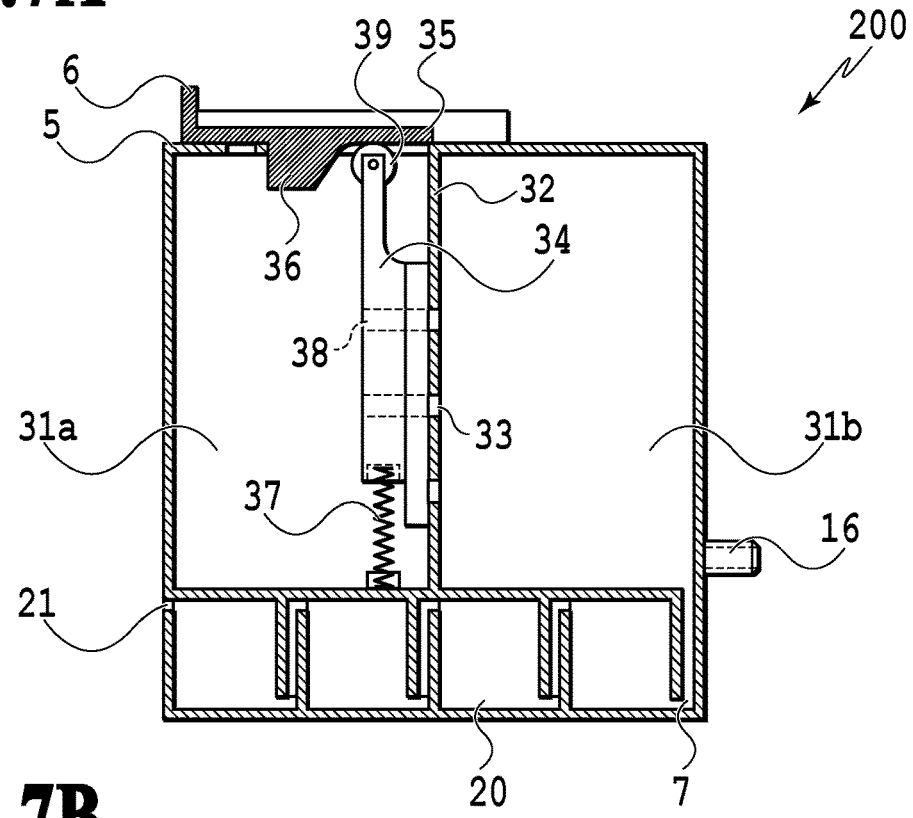
FIG. 7B is a diagram illustrating the liquid storage container.

FIGS. 7A and 7B are diagrams illustrating a liquid storage container 200 in this embodiment. FIG. 7A is a transparent perspective view, and FIG. 7B is a cross-sectional view. The liquid storage container 200 includes a liquid chamber 31*a* and a liquid chamber 31*b*, and a wall 32 partitioning the liquid chamber 31*a* and the liquid chamber 31*b* is provided with holes 33 that allows the liquid chamber 31*a* and the liquid chamber 31*b* to communicate with each other. Additionally, the wall 32 is provided with a slider 34 that can open and close the holes 33. The slider 34 also has holes 38, and in the case where the holes 33 in the wall 32 and the holes 38 in the slider 34 communicate with one another, the liquid chamber 31*a* and the liquid chamber 31*b* communicate with each other.

With the slider 34 being biased upward by a spring 37 provided below the slider 34, the holes 33 in the wall 32 are aligned with the holes 38 in the slider 34, and thus the liquid chamber 31*a* and the liquid chamber 31*b* communicate with each other. In this case, it is desirable that the material of the spring 37 be a material that has a resistance and a wettability to the ink W and has an excellent corrosion resistance, such as an austenitic stainless steel. A sliding lid 35 including a cam plate 36 is provided on the top of the liquid storage container 200, and the sliding lid 35 and the slider 34 are configured to move in conjunction with each other.

Specifically, with the sliding lid 35 sliding, the cam plate 36 is brought into contact with a cam roller 39 provided on the top of the slider 34 so as to press the slider 34 downward, and the slider 34 is thus moved in a vertical direction. Accordingly, the positions of the holes 38 in the slider 34 are shifted from the positions of the holes 33 in the wall 32, interrupting the communication between the liquid chamber 31*a* and the liquid chamber 31*b*. The refilling port 5 under the sliding lid 35 can be switched between a close state and an open state depending on a horizontal position of the sliding lid 35. It is desirable that moving ranges of the sliding lid 35 and the slider 34 be restricted to some extent, and the moving range of the slider 34 may be restricted by providing a stopper or the like at a movable-range end.

Figure 8A:
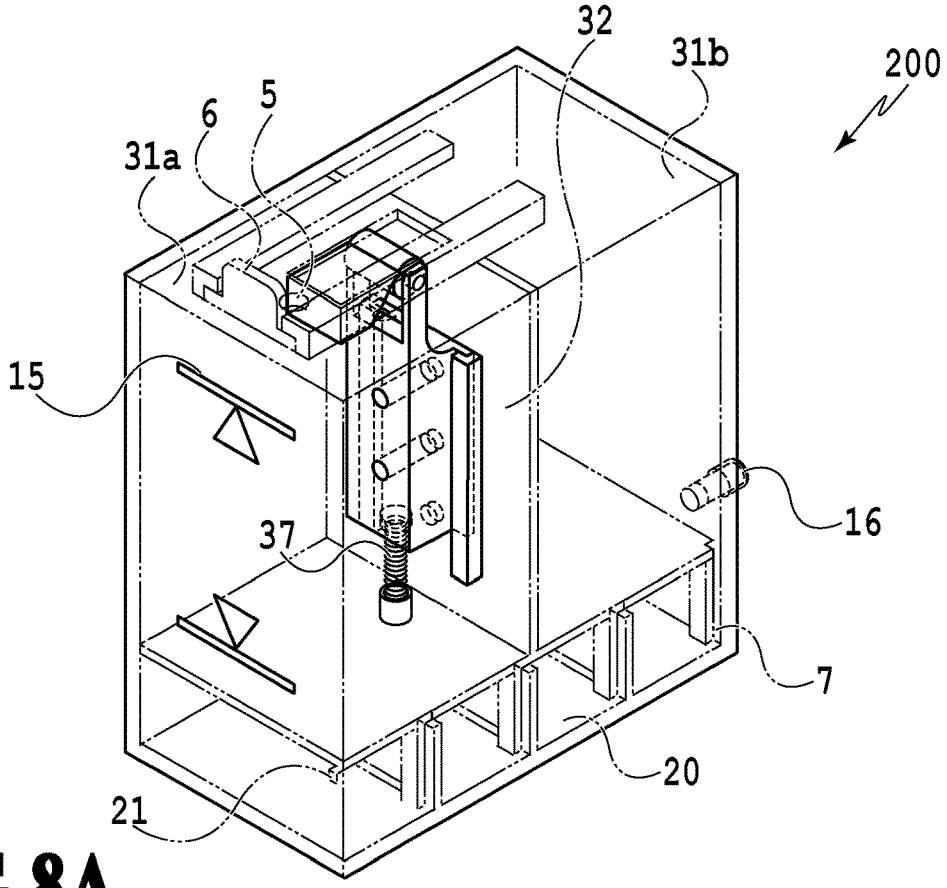
FIG. 8A is a diagram illustrating ink refilling operations in the liquid storage container in sequence.
Figure 8B:
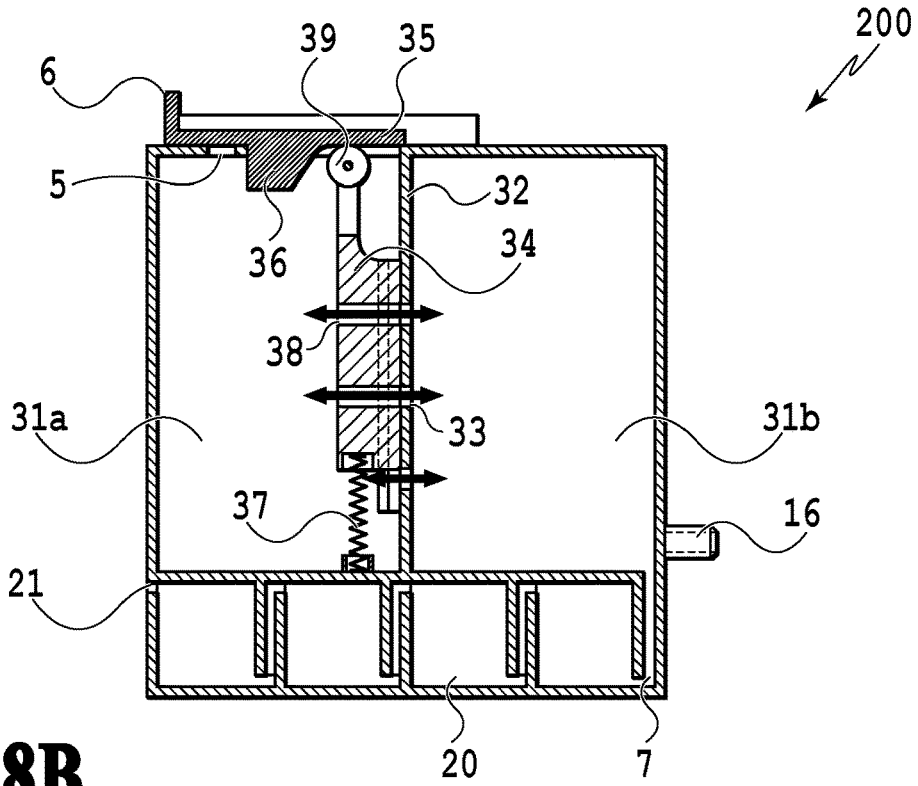
FIG. 8B is a diagram illustrating the ink refilling operations in the liquid storage container in sequence.

FIGS. 8A to 10B are diagrams illustrating ink refilling operations in the liquid storage container 200 in sequence. The ink refilling operations are performed with the opening and closing of the sliding lid 35. In a state where the sliding lid 35 is completely closed as illustrated in FIGS. 8A and 8B, the inside spaces of the liquid chamber 31*a* and the liquid chamber 31*b* are connected to each other via the holes 33 and the holes 38 in the slider 34 communicating with one another, and the liquid storage container 200 is thus used as a large volume ink storage container. In the state illustrated in FIGS. 8A and 8B, the refilling port 5 under the sliding lid 35 is closed, and the ink pressure is in a state adjusted by the effect of the gas introduction unit 7. In the case where the user finds that the amount of the ink in the liquid storage container 200 has been decreased, and that the liquid surface of the ink has reached the lower limit of the indicator 15, the user performs the ink refilling operations.

Figure 9A:
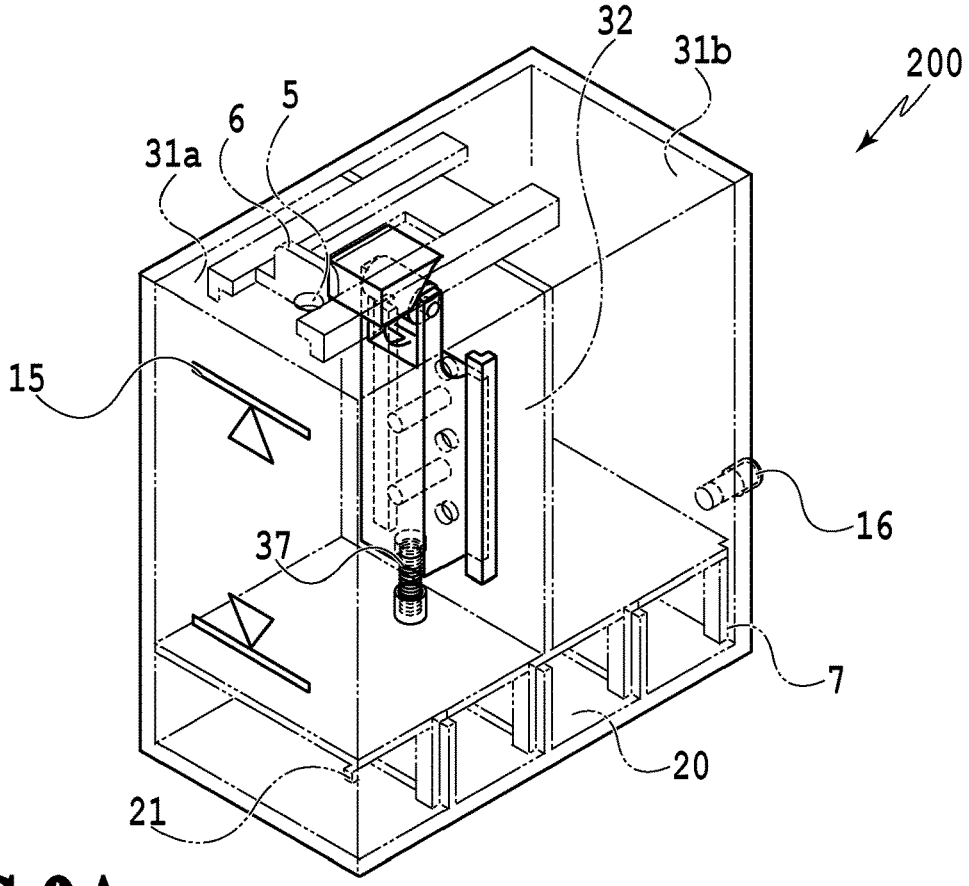
FIG. 9A is a diagram illustrating the ink refilling operations in the liquid storage container in sequence.
Figure 9B:
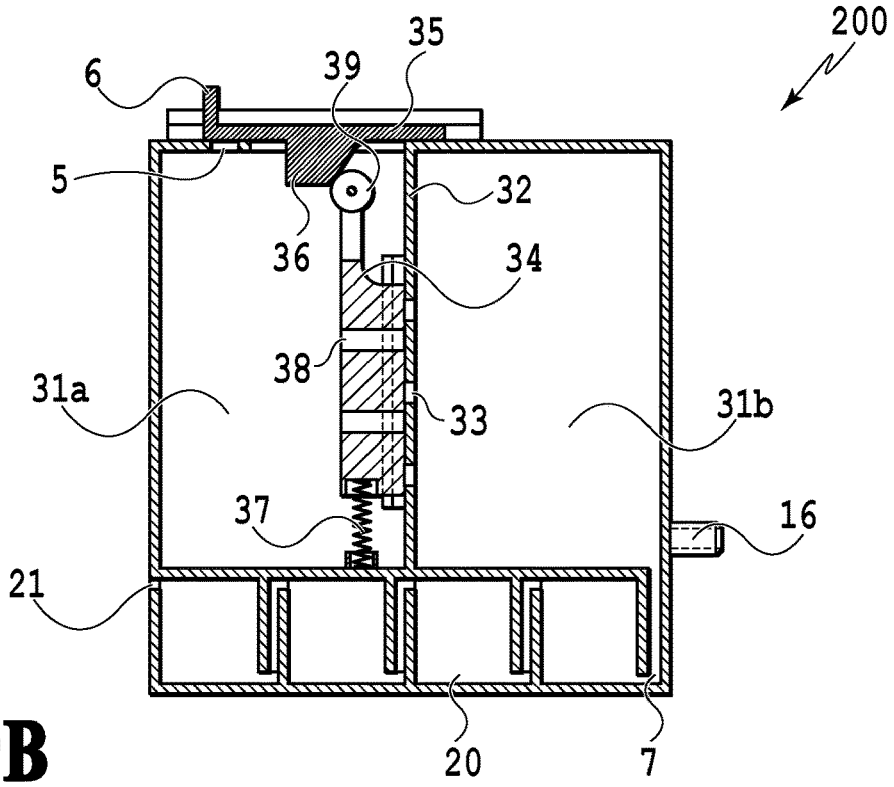
FIG. 9B is a diagram illustrating the ink refilling operations in the liquid storage container in sequence.
Figure 10A:
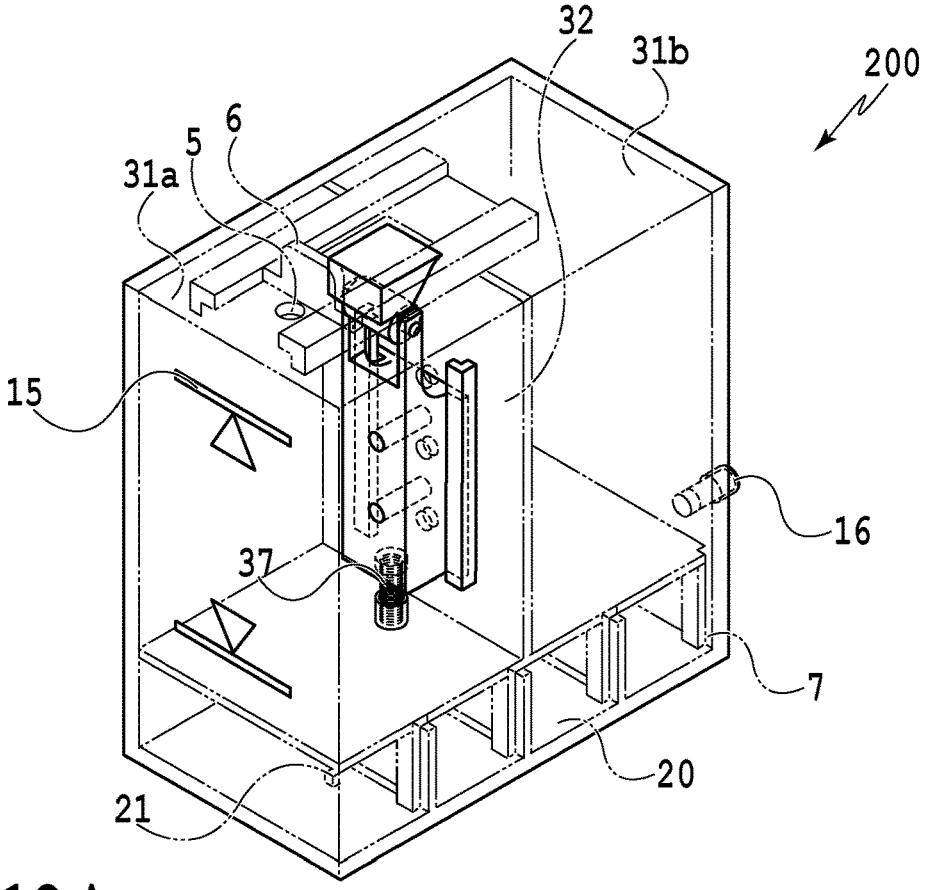
FIG. 10A is a diagram illustrating the ink refilling operations in the liquid storage container in sequence.
Figure 10B:
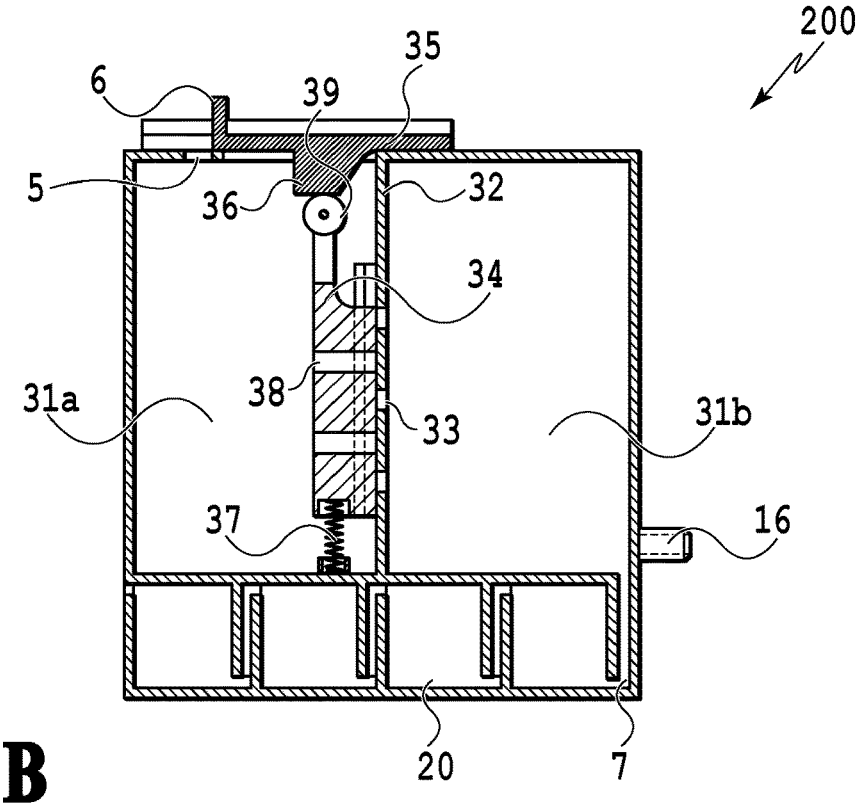
FIG. 10B is a diagram illustrating the ink refilling operations in the liquid storage container in sequence.

Once the ink refilling operations are started, the user slides the sliding lid 35 in an arrow direction by about a half of the movable range as illustrated in FIGS. 9A and 9B. In conjunction with the movement of the sliding lid 35, the slider 34 moves downward in the vertical direction by a cam mechanism, the holes 33 in the wall 32 partitioning the liquid chamber 31*a* and the liquid chamber 31*b* are covered, the ink flow path is closed, and the inside spaces of the liquid chamber 31*a* and the liquid chamber 31*b* are separated from each other. In the state illustrated in FIGS. 9A and 9B, the refilling port 5 is closed. In the case where the user further opens the sliding lid 35 to the movable-range end from the state illustrated in FIGS. 9A and 9B, and the liquid storage container 200 turns into a fully open state as illustrated in FIGS. 10A and 10B, the refilling port 5 in the top of the liquid chamber 31*a* opens while the inside space of the liquid chamber 31*b* remains separated, allowing the liquid chamber 31*a* to be refilled with ink.

In the case where the user supplies ink through the refilling port 5 to the liquid chamber 31*a*, and the ink liquid surface reaches the upper limit of the indicator 15, the user stops supplying the ink. Since the liquid chamber 31*a* and the liquid chamber 31*b* are separated from each other while the liquid chamber 31*a* is being refilled with the ink W, the liquid chamber 31*b* is not refilled with the ink. While the liquid chamber 31*a* is being refilled with the ink W, the ink supply path from the liquid chamber 31*b* to the printing head and the ink holding chamber remains open, and the ink pressures in the liquid chamber 31*b*, the supply path, and the printing head are in states adjusted by the effect of the gas introduction unit 7. Consequently, even in a case where the refilling port 5 is open in the liquid chamber 31*a*, the ink never flows backward in the liquid chamber 31*b*, and thus it is possible to perform printing during the ink refilling without degradation in the accuracy of printing.

After the user completes the ink refilling as described above, the user closes the sliding lid 35. Thereby, the refilling port 5 is closed, and the slider 34 is moved to allow the liquid chamber 31*a* and the liquid chamber 31*b* to communicate with each other. Thus, the ink refilling operations are completed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-093155, filed May 28, 2020 which is hereby incorporated by reference wherein in its entirety.

What is claimed is:

1. A liquid storage container capable of supplying liquid to a printing head through a supply path, the printing head being configured to eject the liquid, and capable of retaining the liquid, comprising:

at least two liquid chambers partitioned from each other;

a flow path through which the liquid can move between the liquid chambers;

a valve configured to open and close the flow path;

a refilling port that is configured to be opened and closed and through which one of the liquid chambers can be refilled with the liquid; and a pressure adjustment mechanism that is provided in one of the liquid chambers, the one being configured not to be refilled with the liquid through the refilling port, and that adjusts pressures in the supply path and the printing head, wherein the pressure adjustment mechanism includes an atmosphere communication port that is provided in a lower portion of the liquid chamber in an orientation in use to communicate with the atmosphere.

2. The liquid storage container according to claim 1, wherein the refilling port is opened and closed along with the opening and the closing of the valve.

3. The liquid storage container according to claim 2, wherein the valve is closed while the refilling port is open.

4. The liquid storage container according to claim 1, wherein the valve is a slider that opens and closes the flow path by sliding.

5. The liquid storage container according to claim 4, wherein the slider operates in conjunction with a sliding lid by a cam mechanism, the sliding lid being configured to open and close the refilling port.

6. The liquid storage container according to claim 1, wherein the pressure adjustment mechanism includes a labyrinth structure.

7. The liquid storage container according to claim 1, further comprising an indicator that indicates an upper limit and a lower limit of the liquid.

8. A liquid storage container capable of supplying liquid to a printing head through a supply path, the printing head being configured to eject the liquid, and capable of retaining the liquid, comprising:

at least two liquid chambers partitioned from each other;

a flow path through which the liquid can move between the liquid chambers;

a valve configured to open and close the flow path;

a refilling port that is configured to be opened and closed and through which one of the liquid chambers can be refilled with the liquid; and a pressure adjustment mechanism that is provided in one of the liquid chambers, the one being configured not to be refilled with the liquid through the refilling port, and that adjusts pressures in the supply path and the printing head, wherein in a case where the refilling port is closed after the liquid refilling is performed through the refilling port, the valve is opened.

9. The liquid storage container according to claim 8, wherein the refilling port is opened and closed along with the opening and the closing of the valve.

10. The liquid storage container according to claim 9, wherein the valve is closed while the refilling port is open.

11. The liquid storage container according to claim 8, wherein the valve is a slider that opens and closes the flow path by sliding.

12. The liquid storage container according to claim 11, wherein the slider operates in conjunction with a sliding lid by a cam mechanism, the sliding lid being configured to open and close the refilling port.

13. The liquid storage container according to claim 8, wherein the pressure adjustment mechanism includes a labyrinth structure.

14. The liquid storage container according to claim 8, further comprising an indicator that indicates an upper limit and a lower limit of the liquid.

15. A liquid storage container capable of supplying liquid to a printing head through a supply path, the printing head being configured to eject the liquid, and capable of retaining the liquid, comprising:

at least two liquid chambers partitioned from each other;

a flow path through which the liquid can move between the liquid chambers;

a valve configured to open and close the flow path;

a refilling port that is configured to be opened and closed and through which one of the liquid chambers can be refilled with the liquid; and a pressure adjustment mechanism that is provided in one of the liquid chambers, the one being configured not to be refilled with the liquid through the refilling port, and that adjusts pressures in the supply path and the printing head, wherein the valve is in a cylindrical shape including a space therein, is rotatable about an axis of the cylinder, and opens and closes the flow path along with the rotation.

16. The liquid storage container according to claim 15, wherein the refilling port is opened and closed along with the opening and the closing of the valve.

17. The liquid storage container according to claim 16, wherein the valve is closed while the refilling port is open.

18. The liquid storage container according to claim 15, wherein the pressure adjustment mechanism includes a labyrinth structure.

19. The liquid storage container according to claim 15, further comprising an indicator that indicates an upper limit and a lower limit of the liquid.

* * * * *